United States Patent [19]

Lawrie

[11] 4,178,863

[45] Dec. 18, 1979

[54] FEED CAM REPHASING DEVICE

[75] Inventor: Donald Lawrie, Clydebank, Scotland

[73] Assignee: The Singer Company, New York, N.Y.

[21] Appl. No.: 16,636

[22] Filed: Mar. 1, 1979

[30] Foreign Application Priority Data

Dec. 20, 1978 [GB] United Kingdom ..... 49195/78

[51] Int. Cl.[2] ..... D05B 3/02; D05B 3/04

[52] U.S. Cl. ..... 112/158 D

[58] Field of Search ..... 112/158 D, 158 R, 158 A, 112/158 F, 158 B; 74/568 R

[56] References Cited

U.S. PATENT DOCUMENTS

| | | | |
|---|---|---|---|
| 2,879,732 | 3/1959 | Casas-Robert et al. | 112/158 R |
| 2,999,471 | 9/1961 | Benink et al. | 112/158 R |
| 3,214,996 | 11/1965 | Bono | 112/158 R |
| 3,540,389 | 11/1970 | Graham | 112/158 A |
| 3,648,633 | 3/1972 | Adams | 112/158 R |

*Primary Examiner*—Werner H. Schroeder

*Assistant Examiner*—Andrew M. Falik

*Attorney, Agent, or Firm*—Edward P. Schmidt; Robert E. Smith; Edward L. Bell

[57] ABSTRACT

A device permitting the rotation of a feed cam to a selected one of two positions in order to multiply the pattern capability of the sewing machine. A feed cam is supported in a sewing machine in a fashion to permit limited circumferential rotation with respect to a cam shaft. An actuator knob is keyed to the feed cam in a fashion to allow limited axial motion thereof while retaining a connection to the feed cam. The actuator is separably keyed to a positioning bushing affixed to the sewing machine cam shaft. Axial shift of the actuator towards the feed cam will disengage the actuator from the positioning bushing and permit rotation of the actuator and feed cams. The actuator may then be reengaged with the positioning bushing in a new position. The feed cam is thus driven through the actuators connection to the positioning bushing affixed to the cam shaft.

3 Claims, 8 Drawing Figures

FEED CAM REPHASING DEVICE

BACKGROUND OF THE INVENTION

This invention is in the field of sewing machines; more particularly, it is concerned with a device to change the phase relationship between a feed cam or cams and the lateral needle deflection cam or cams of a sewing machine.

In sewing machines having ornamental pattern capability, it is generally provided that needle deflection cams are used in conjunction with feed cams in order to provide ornamental patterns necessitating backward and forward motion of the work material in addition to the deflection of the sewing needle. It has been observed that with certain utilitarian needle deflection cams such as blind stitch or multistitch, a feed cam may be utilized which will provide for other utilitarian or ornamental stitches by utilizing the variable feed thus provided. It is further known in the sewing machine art that additional utilitarian and ornamental patterns can be obtained by rephasing the feed cam, that is, by altering the angular relationship between the feed cams and the needle position cams. Such an arrangement is shown in U.S. Pat. No. 2,999,471 issued on Sept. 12, 1961, to Benick et al. In the above noted patent, there are disclosed two feed cams which may be rotated to any one of twelve positions with respect to the needle position cams and any one of two different heights to permit utilization of a selected one of the feed cams. Such a device presents a degree of complexity to an operator which may inhibit the use of such a device.

What is required is a simple device which may be readily comprehended by an operator in order to obtain patterns having a high degree of ornamental and utilitarian use.

SUMMARY OF THE INVENTION

The above requirements are achieved in an invention wherein a limited number of selectable patterns are obtainable by a simple operator manipulation. A single feed cam is positioned atop a stack of needle position cams, all of which are supported on a cam shaft. The cams sit atop a platform affixed to the cam shaft, the platform supporting a stud rising parallel to the cam shaft through radial slots in the needle position cam to a circumferential slot in the feed cam. Thus, the needle position cams are maintained in a fixed angular relationship on the cam shaft while the feed cam may undergo limited circumferential motion. The upper surface of the feed cam is formed with upstanding lugs which extend into cavities in an actuator. The actuator is biased upwardly by a retaining spring against a positioning bushing which is retained in a fixed position by a positioning bushing screw affixed to the cam shaft. The lower surface of the positioning bushing is fashioned with an integral key arranged to slide into one of a pair of cavities formed in an upper surface of the actuator. Depression of the actuator against the retaining spring will disengage the key on the positioning bushing from a cavity on the actuator and permits the actuator to undergo limited rotation to that point where the key may reengage with the second cavity in the actuator. By the slidable connection of the upstanding lugs of the feed cam with the actuator, rotation of the actuator will also cause rotation of the feed cam. Thus, relocating the key of the positioning bushing from one cavity to the other cavity will cause a rotation of the feed cam with respect to the needle position cams carried by the cam shaft in a fixed position.

DESCRIPTION OF THE DRAWINGS

In the accompanying drawings, a preferred embodiment of this invention is illustrated in which:

Referring to FIG. 1, there is shown a portion of a sewing machine 10 including a work supporting bed 12 from which rises a standard 14 supporting a bracket arm 16 in overhanging relationship to the work supporting bed. The bracket arm 16 terminates in a head portion 18 within which is supported, in the usual fashion in the sewing machine art, an endwise reciprocating and laterally oscillatable needle bar 20 to the end of which there is affixed by screw 21 a sewing needle 22. Also supported within the head portion 18 in the usual fashion is a presser bar 24 terminating in a presser foot 26, the combination of which urges a work material against feed dogs (not shown), part of a work feed system (not shown) which is supported in the work supporting bed 12.

Figure 1:
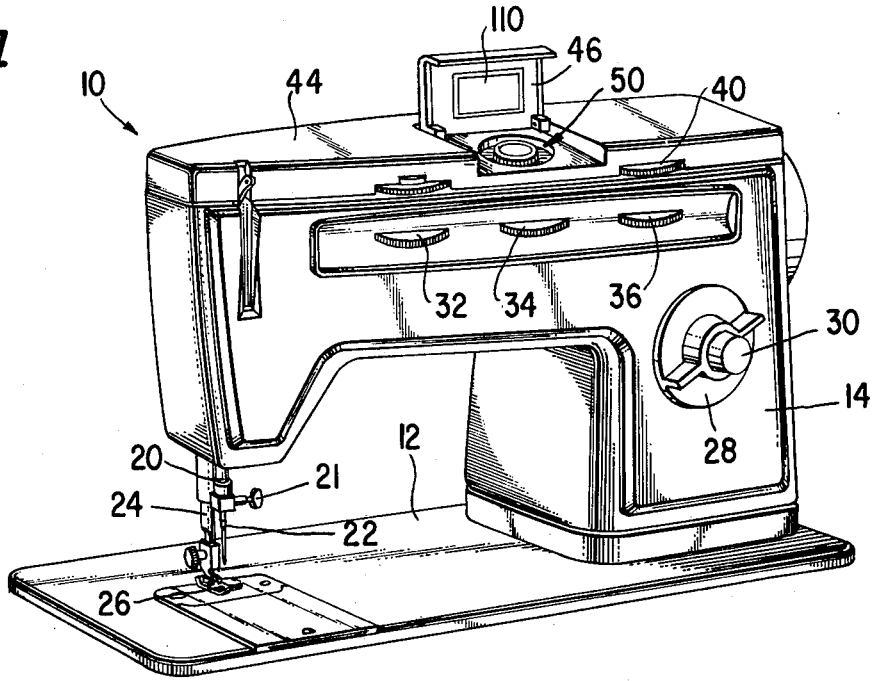
FIG. 1 is a perspective view of a sewing machine in which the invention may be incorporated.

On the standard 14 there is supported a feed control dial 28 for adjusting the rate of feed in a forward direction. Coaxially with the feed control dial 28 there is supported a reversing button 30 which may be used to alter direction of feed of the work material. Within the bracket arm 16 there is shown supported the dial 32 by which selection of utilitarian or ornamental patterns may be made. Adjacent the pattern selection dial 32 there is located a second dial 34 which is used to determine the bight for stitch width actuated by the sewing needle 21. A third dial 36 is provided by which right, center or left needle position may be selected. For further information on the linkage actuated by the pattern selection dial 32, stitch width dial 34 and needle position dial 36, the reader is referred to U.S. Pat. No. 3,786,769 issued on Jan. 26, 1974, to Coulombe, which is assigned to the same assignee as the instant invention, and which is hereby incorporated by reference herein.

In addition to the above dials supported in the bracket arm 16, there is an additional feed cam control dial 40 which may be selectively rotated to establish a connection between a feed cam in the bracket arm and the work feeding system in the bed of the sewing machine 10, or to defeat such a connection. A top cover 44 is utilized to cover the upwardly open cavity in the bracket arm 16. The top cover 14 is fashioned with a hinged lid 46 in order to provide access to a cam stack 50 and the rephasing mechanism thereon subject of this invention.

Figure 2:
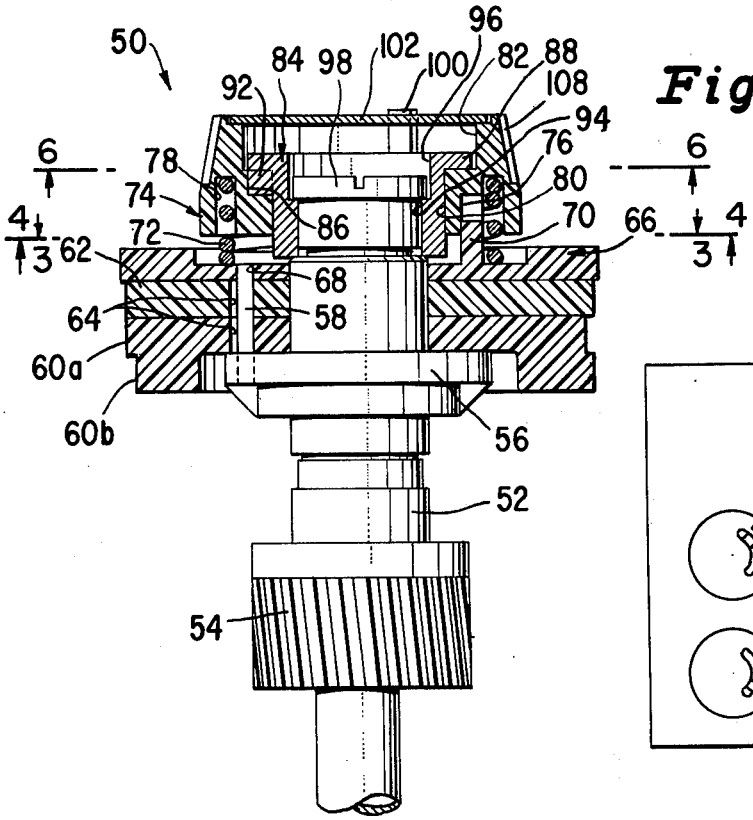
FIG. 2 is a cross sectional view of the cam stack of the sewing machine shown in FIG. 1.

Referring now to FIG. 2, there is shown a cross section of a cam stack 50 visible in FIG. 1. The cam stack 50 is fashioned with a cam shaft 52 to which there is attached a gear 54 for meshing with a worm on the arm shaft (not shown) of the sewing machine 10, in a manner well known in sewing machine art. The cam shaft 52 is fashioned with a platform 56 on which various cams are supported. A pin 58 extends upwardly from the platform parallel to the axis of the cam shaft 52. Needle position cams 6*a*, 60*b* and 62 are supported on the platform 56 and are formed with radial slots 64 to accomodate pin 58 in a fashion to maintain the needle position cams against circumferential play. A feed cam 66 is positioned atop the needle position cams 62, and is fashioned with a circumferential slot 68 (see also FIG. 3) through which the pin 58 extends so that the feed cam may undergo limited rotation relative to the cam shaft 52. The feed cam 66 is also provided with a pair of upstanding lugs 70 (see also FIG. 3). A compression spring 72 sits atop the feed cam 66 and encircles the upstanding lugs 77. An actuator 74 is fashioned with cavities 76 which slidably engage the upstanding lug 70 and with an annular groove 78 which receives the upper end of compression spring 72.

Figure 7:
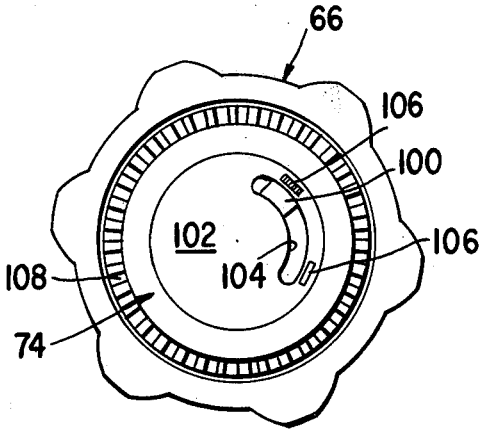
FIG. 7 is a top plan view of the cam stack showing the same as it would be viewed by a sewing machine operator.

The actuator 74 is fashioned with a throughbore 80 and a counterbore 82 to accomodate a positioning bushing 84. The bottom of the cunterbore 82 in the actuator 74 is fashioned with a pair of like cavities (see also FIG. 5) spaced approximately 80° apart. The positioning bushing 84 is fashioned with a rim 88 seated against the counter bore 82, and a circular outer portion 90 extending through the thoughbore 80 of the actuator 74. An integral key 92 extends from the rim 88 of the positioning bushing 84 partially along the outer portion 90. The integral key 92 is dimensioned to fit precisely into a selected one of the like cavities 86 in the actuator 74. The positioning bushing 84 is also fashioned with a counterbore 94 and a throughbore 96 to receive a shouldered positioning bushing screw 98 which is threadedly attached to the cam shaft 52. The positioning bushing screw 98 thus retains the positioning bushing 84 and the actuator 74 onto the cam shaft 52 against the urgings of the compression spring 72. The positioning bushing 84 is further formed with an upstanding lug 100 which extends through a circumferential opening 104 in a plate 102 affixed to the top of the actuator 74 (see also FIG. 7). Colored markings 106 are provided on the plate 102 at the extremities of the circumferential opening 104 for a purpose which will be described below. The external portion of the actuator 74 is serrated as at 108 in order to provide finger grips for an operator manipulating the actuator for a purpose to be explained below.

Figure 6:
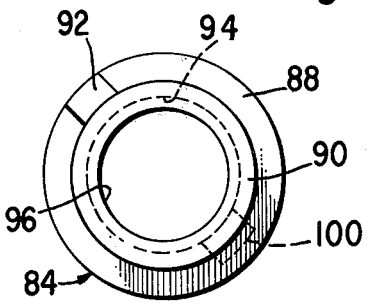
FIG. 6 is a view taken along line 6—6 of FIG. 2 to show the end surface of the positioning bushing which mates with the actuator.
Figure 5:
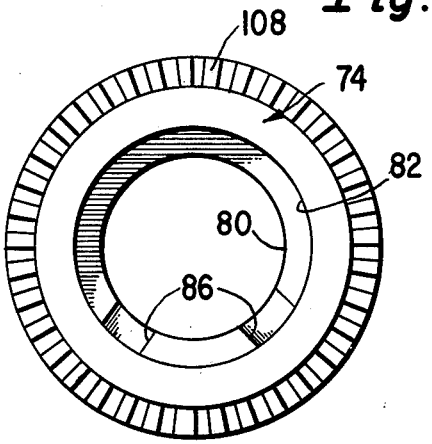
FIG. 5 is a plan view of the actuator of FIG. 2 to show the upper cavities in the actuator.
Figure 3:
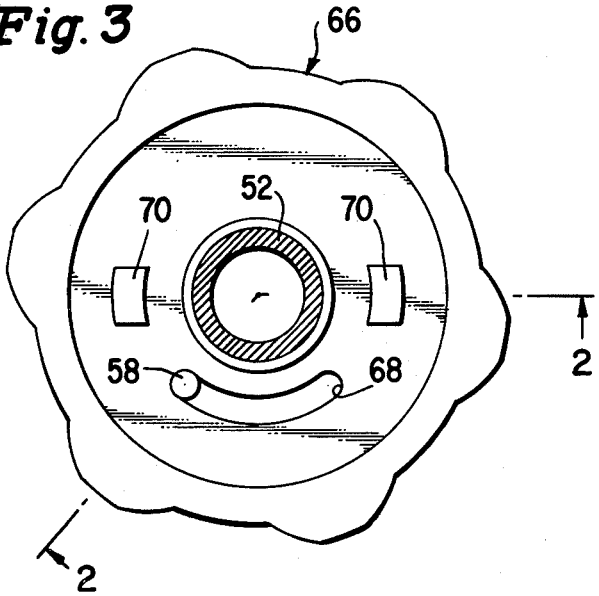
FIG. 3 is a sectional view taken along line 3—3 of FIG. 2 to show an elevation of the feed cam with the upstanding lugs and circumferential slot in the cam.

A further understanding of the invention may be had by reference to FIG. 2 taken in conjunction with references to FIGS. 3 through 7. FIGS. 3 through 6 are cross sections taken of FIG. 2 in order to disclose the interaction among the various component parts during operation of the invention. Thus, FIG. 3 is essentially a plan view of the feed cam 66 indicating its relation to the cam shaft 52 and shows pin 58 extending through the circumferential slot 68. In this view, the pin 58 is located at one extremity of the circumferential slot 68 which is spaced approximately 80° from the other extremity of the slot. The upstanding lugs 70 extending from the feed cam 66 are dimensioned to enter into the cavity 76 visible in the actuator 74 shown in FIG. 4. Thus, as the actuator 74 is rotated, the feed cam 66 will rotate with it. In FIG. 5, is shown the upper surface of the actuator 74 including the counterbore 82 therein. The like cavities 86 extending inwardly from the counterbore 82 are also shown. In FIG. 6 is shown the positioning bushing and the outer portion 90 thereof which fits into the throughbore 80 of the actuator 74. The rim 88 of the positioning bushing 84 is fashioned with a key way 92 which extends down the outer portion 90 and thus into one of the like cavities 86. Also visible in FIG. 6 on the opposite side of the positioning bushing 84 is the upstanding lug 100.

Figure 8:
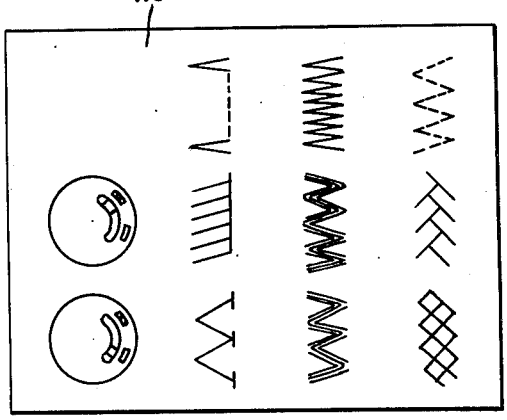
FIG. 8 is an elevation of the chart shown in FIG. 1 which provides the operator with instructions for positioning the actuator.
Figure 4:
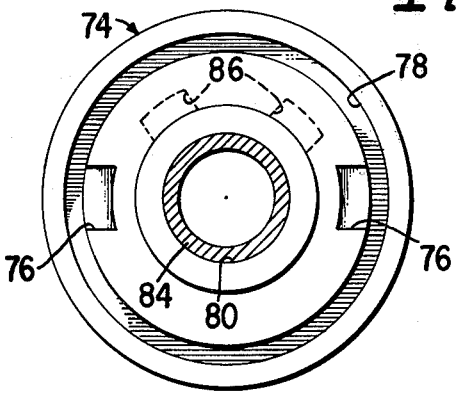
FIG. 4 is a view taken along line 4—4 of FIG. 2 to show the lower surface of the actuator.

As mentioned at the outset, certain utilitarian or ornamental patterns obtainable from needle position cams may be combined with a feed cam designed, for example, to give two forward stitches and one reverse stitch in sequence in order to provide new utilitarian or ornamental patterns having a feed component therein. It has been observed and is well known in the art that by changing the phase relationship between the needle position cam and the feed cam, an entirely new utilitarian or ornamental pattern may be obtained. This is accomplished in the instant invention by rotating the actuator 74 so as to engage the integral key 92 of the positioning bushing 84 from one of the like cavities 86 to the other like cavity thereof. Since the positioning bushing 84 is held fast to the cam shaft 52 by the positioning bushing screw 98, the feed cam 66 is thereby placed in a new relationship with the cam shaft and thereby with the needle position cams 60*a*, 60*b* and 62. An indication of the position of the feed cam 66 with respect to the needle position cams 60*a*, 60*b* and 62 is provided by the upstanding lug 100 of the positioning bushing 84 extending through the plate 102. The colored markings 106 may be coded to the chart 110 affixed to the hinged lid 46 and shown in FIG. 8. In the top line of the chart 110, there is shown the patterns available from the needle position cams 60*a*, 60*b*, 62; obtainable by manipulation of the pattern selection dial 32, if the feed cam control dial 40 is in a position to provide no connection between the feed cam 66 and the work feeding system of the sewing machine. Thus, the patterns available are blind stitch, zigzag and multistitch. If the feed cam control dial 40 is manipulated to a position connecting the feed cam 66 to the work feeding system of the sewing machine, and the actuator 74 has been manipulated to the most clockwise position shown in FIG. 7, the corresponding feed control patterns slant overedge, rickrack and feather stitch are available, depending upon the needle cam selected by manipulation of the pattern selection dial 32. If the feed cam 66 is rephased by manipulating the actuator 74 to the most counterclockwise position, the new feed control patterns available are pyramid overedge, rickrack and honeycomb. Thus, a sewing operator may in a most simple fashion obtain the capability of performing additional feed control patterns by manipulation of an actuator 74, and without the necessity for substituting cams.

Having thus set forth the nature of the invention, what is sought to be claimed is:

1. A sewing machine comprising a frame; a needle bar supported in said frame for endwise reciprocation and lateral oscillation; a work feeding system supported in said frame for urging work material in a direction transverse said lateral oscillation of said needle bar; said frame further supporting at least one first cam, first means operatively connecting said at least one first cam to said needle bar for influencing lateral oscillation thereof, a second cam, a second means operatively connecting said second cam to said work feeding mechanism for regulating the direction and rate at which work material is urged, and drive means for urging said needle bar in endwise reciprocation, for operting said work feeding system and for driving said first and second cams, and means for supporting said second cam for selective rotative repositioning to a first and second position relative to said at least one first cam, said support means including a cam shaft, means for mounting said second cam on said cam shaft in a fashion to accomodate selective rotative repositioning of said second cam, a repositioning bushing affixed to said cam shaft, and an actuator interposed between said bushing and said second cam, said actuator and said bushing having interacting means thereon for maintaining a selected one of a plurality of possible angular relationships between said actuator and said bushing, means for connecting said actuator to said second cam for rotation therewith and for limited axial movement of said actuator to and from said second cam, resilient means for biasing said actuator into engagement with said positioning bushing in a selecting one of said plurality of angular relationships of said actuator and said bushing whereby movement of said actuator against the urgings of said resilient means will disengage the interacting means from engagement in said selected one of said plurality of possible angular relationships to permit rotative repositioning of said actuator and said second cam to obtain reengagement of said interacting means in another of said plurality of possible angular relationships.

2. A sewing machine as claimed in claim 1, where in said interacting means includes a lug on said positioning bushing in engagement with one of a pair of cavities in said actuator, whereby said actuator may undergo limited axial movement to remove said lug of said positioning bushing from a cavity in said actuator to permit rotation of said actuator and said second cam to a new angular position relative to said first cam and, under the bias of said resilient means, reengage said lug of said positioning bushing with the other of said cavities of said actuator.

3. A sewing machine as claimed in claim 2 wherein said positioning bushing is fashioned with an upstanding indicating finger, and wherein said actuator supports a plate therein, said plate being fashioned with a circumferential slot accommodating said upstanding finger of said positioning bushing, said upstanding finger being at one extremity of said circumferential slot when said lug is in a first cavity of said actuator and said upstanding finger be located at the other extremity of said circumferential slot when said lug of said positioning bushing is located in the second cavity of said actuator.

* * * * *